US010702758B2

(12) United States Patent
Elzinga

(10) Patent No.: US 10,702,758 B2
(45) Date of Patent: Jul. 7, 2020

(54) PUTTING GREEN MEASURING SYSTEM

(71) Applicant: Brayden Elzinga, Byron Center, MI (US)

(72) Inventor: Brayden Elzinga, Byron Center, MI (US)

(73) Assignee: Brayden Elzinga, Byron Center, MI (US)

( * ) Notice: Subject to any disclaimer, the term of this patent is extended or adjusted under 35 U.S.C. 154(b) by 0 days.

(21) Appl. No.: 16/120,578

(22) Filed: Sep. 4, 2018

(65) Prior Publication Data

US 2019/0070479 A1 Mar. 7, 2019

Related U.S. Application Data

(60) Provisional application No. 62/553,842, filed on Sep. 2, 2017.

(51) Int. Cl.
*A63B 69/36* (2006.01)
*A63B 1/00* (2006.01)

(52) U.S. Cl.
CPC ..... *A63B 69/3676* (2013.01); *A63B 1/00* (2013.01); *A63B 2220/20* (2013.01)

(58) Field of Classification Search
CPC ... A63B 69/3676; A63B 2220/20; A63B 1/00; G01B 3/1084; G01B 2003/1097; G01B 3/1041; G01B 2003/1089; G01B 2003/1094
See application file for complete search history.

(56) References Cited

U.S. PATENT DOCUMENTS 1,653,191 A * 12/1927 Savage ..... B44D 3/38 33/414
2,041,119 A * 5/1936 Duganne ..... A63B 57/40 473/176
3,191,308 A * 6/1965 Lindenau ..... G01B 3/1041 33/414
3,604,711 A * 9/1971 Hansburg ..... A63B 69/3676 473/257
3,834,030 A * 9/1974 Hanson ..... A63B 57/00 33/759
4,023,277 A * 5/1977 Fizer ..... B43L 9/045 33/27.03
4,273,329 A * 6/1981 Trigg ..... A63B 57/00 473/407
4,532,712 A * 8/1985 Vistain ..... A63B 57/00 33/613
4,880,232 A * 11/1989 Lang ..... A63B 57/40 473/176

(Continued)

*Primary Examiner* — Steven B Wong
(74) *Attorney, Agent, or Firm* — The Watson IP Group, PLC; Jovan N. Jovanovic

(57) ABSTRACT

A putting green measuring system having a central base, a remote marking assembly, a cable and an adjustable measurement assembly. The central base is positionable within a hole on a putting green. The remote marking assembly is structurally configured to retain a tape and to apply the same when traversed across the ground. The cable extends from the remote marking assembly and the central base. The adjustable measurement assembly is positioned on one of the central base and the remote marking assembly to controllably determine and maintain the length of the cable between the remote marking assembly and the central base.

15 Claims, 15 Drawing Sheets

(56) References Cited

U.S. PATENT DOCUMENTS

| | | | | | |
|---|---|---|---|---|---|
| 5,253,421 | A * | 10/1993 | Landmark | B43L 9/04 | 33/27.03 |
| D377,611 | S * | 1/1997 | Miklas | D10/70 | |
| 6,754,974 | B2 * | 6/2004 | Bassolino | A63B 67/068 | 33/1 G |
| 7,062,859 | B1 * | 6/2006 | Revnell | B43L 12/00 | 33/32.1 |
| 7,191,530 | B1 * | 3/2007 | Thibodeaux | B43L 9/045 | 33/27.03 |
| 7,708,658 | B2 * | 5/2010 | McInerney | A63B 21/153 | 473/407 |
| 8,317,633 | B2 * | 11/2012 | Maclean | A63B 69/3676 | 473/177 |
| 8,801,546 | B2 * | 8/2014 | Roark | A63B 67/068 | 33/759 |
| D749,003 | S * | 2/2016 | Pollitt | D10/72 | |
| 2006/0185185 | A1 * | 8/2006 | Scarborough | G01B 3/1084 | 33/759 |
| 2006/0211521 | A1 * | 9/2006 | Bryant | A63C 19/08 | 473/451 |
| 2007/0068021 | A1 * | 3/2007 | Fisher | B44D 3/38 | 33/414 |
| 2009/0318247 | A1 * | 12/2009 | Cannata | A63B 57/00 | 473/407 |

* cited by examiner

PUTTING GREEN MEASURING SYSTEM

CROSS-REFERENCE TO RELATED APPLICATION

This application claims priority from U.S. Pat. App. Ser. No. 62/553,842 filed Sep. 2, 2017, entitled "Putting Green Measuring System," the entire disclosure of which is hereby incorporated by reference in its entirety.

BACKGROUND OF THE DISCLOSURE

1. Field of the Disclosure

The disclosure relates in general to a golf aid, and more particularly, to a golf measuring system which can provide concentric rings or the like around a hole in a putting green, to aid a user practicing on the putting green.

2. Background Art

The sport of golfing has been played for centuries. Increasingly, the sport of golf has benefited from technological advancements. Such advancements have occurred to the golf ball as well as to multiple features of each of woods, irons and putters. Even with the advancements, golf continues to be a difficult game to master; the game requires not only the equipment but practice and repetition.

Among one of the most challenging parts of the game is putting. That is, about half of the strokes if not more occur on the putting green. As such, mastery of putting is critical to an overall competitive game. Problematically, there are a few aids that provide the necessary feedback to a user to determine improvement, and to assist with improvement in putting. It is known that providing feedback and registering improvement is often times the best manner in which to improve at a particular facet of the game of golf. It would be helpful if additional aids were provided to assist those playing the game of golf with their putting skills.

SUMMARY OF THE DISCLOSURE

The disclosure is directed to a putting green measuring system. The system has a central base, a remote marking assembly, a cable and an adjustable measurement assembly. The central base is positionable within a hole on a putting green. The remote marking assembly is structurally configured to retain a tape and to apply the same when traversed across the ground. The cable extends from the remote marking assembly and the central base. The adjustable measurement assembly is positioned on one of the central base and the remote marking assembly to controllably determine and maintain the length of the cable between the remote marking assembly and the central base In some configurations, the central base further comprises: a hole engaging outer body and an upper engagement ring rotatably coupled to the hole engaging outer body. The adjustable measurement assembly is positioned on the upper engagement ring and rotatable relative to the hole engaging outer body.

In some configurations, the central base further includes a pivoting axle coupled to each of the hole engaging outer body and the upper engagement ring. The upper engagement ring is rotatable relative to the hole engaging outer body about an axis defined by the pivoting axle.

In some configurations, the upper engagement ring further includes an upstanding wall defining an annular slot. The upper engagement ring having a depending tab structurally configured to be positionable within the annular slot.

In some configurations, the upstanding wall has an outer surface that substantially corresponds to a cup on a putting green.

In some configurations, the adjustable measurement assembly further comprises a cable control assembly comprising a cogged wheel and a pawl assembly. The pawl assembly includes a pawl structurally configured to retain the cogged wheel in a desired orientation.

In some configurations, the pawl assembly is configured to allow rotation of the cogged wheel in a first direction, while precluding rotation of the cogged wheel in a second direction, which is opposite of the first direction.

In some configurations, the pawl assembly further includes a biasing member, with a release handle configured to allow a user to overcome the biasing member, so as to separate the pawl from the cogged wheel.

In some configurations, the adjustable measurement assembly further includes a housing extending over the cable control assembly. The housing has an opening to a cavity within the central base in which a portion of the cable can be stored.

In some configurations, the device further includes a handle coupled to the cogged wheel, the handle configured to allow for user rotation of the cogged wheel.

In some configurations, the housing encases the cogged wheel, and includes a dispensing opening configured to allow the cable to exit the housing, while a portion of the cable remains engaged with the cogged wheel.

In some configurations, the remote marking assembly further comprises a handle member and a tape dispenser. The handle member has a first end and a second end, with the cable being attached to the handle member proximate the second end. The tape dispenser assembly is positioned at the second end.

In some configurations, the tape dispenser assembly includes a dispensing roller having an axis that is substantially perpendicular to an axis defined by the handle member.

In some configurations, the remote marking assembly further includes a cutting assembly, structurally configured to cut tape that is dispensable from the tape dispenser assembly.

In some configurations, the cutting assembly further includes a movable blade and a remote actuator assembly configured to move the blade relative to the tape dispenser assembly.

In some configurations, the remote actuator assembly comprises a cord having a first end and a second end. The first end is coupled to the blade and a second end extending through the handle member to the first end thereof, and attached to a grasping structure. Movement of the grasping structure relative to the first end of the handle member moves the cord, and in turn, the blade.

In some configurations, the cable comprises a base member with a plurality of spaced apart cogs.

In some configurations, the adjustable measurement assembly is coupled to the central base.

In another aspect of the disclosure, the disclosure is directed to a method of using a putting green measuring device, including such a device of the above configurations. The method includes the steps of: inserting the central base into a cup of a putting green; adjusting the cable through the adjustable measurement assembly so that the remote marking assembly is spaced apart from the central base a desired distance; directing the remote marking assembly through at least a partial revolution about the cup of a putting green;

and dispensing tape from the remote marking assembly during the step of directing onto the putting green.

In some configurations, the method includes the step of cutting the tape after the step of dispensing.

BRIEF DESCRIPTION OF THE DRAWINGS

The disclosure will now be described with reference to the drawings wherein.

DETAILED DESCRIPTION OF THE DISCLOSURE

Figure 1:
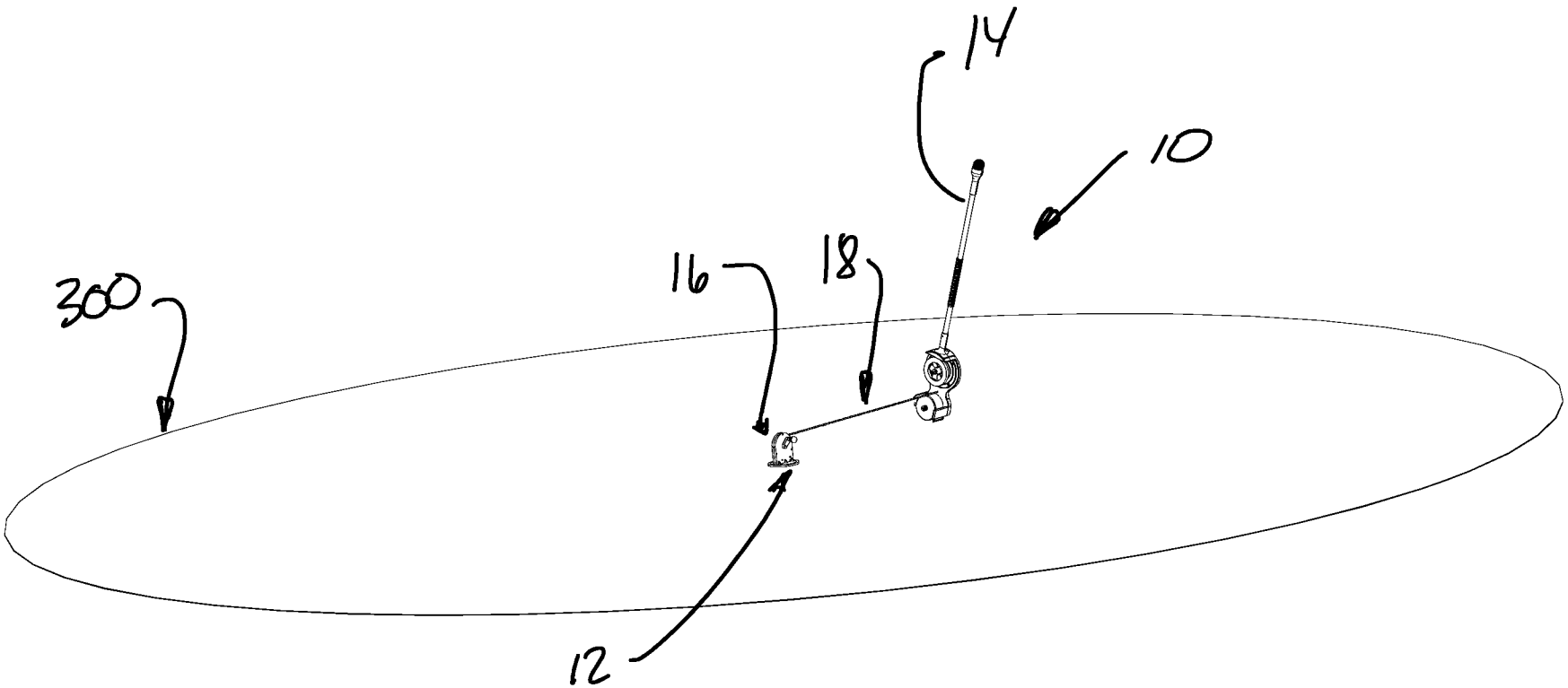
FIG. 1 of the drawings is a perspective view of the putting green measuring system in use about a putting green.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
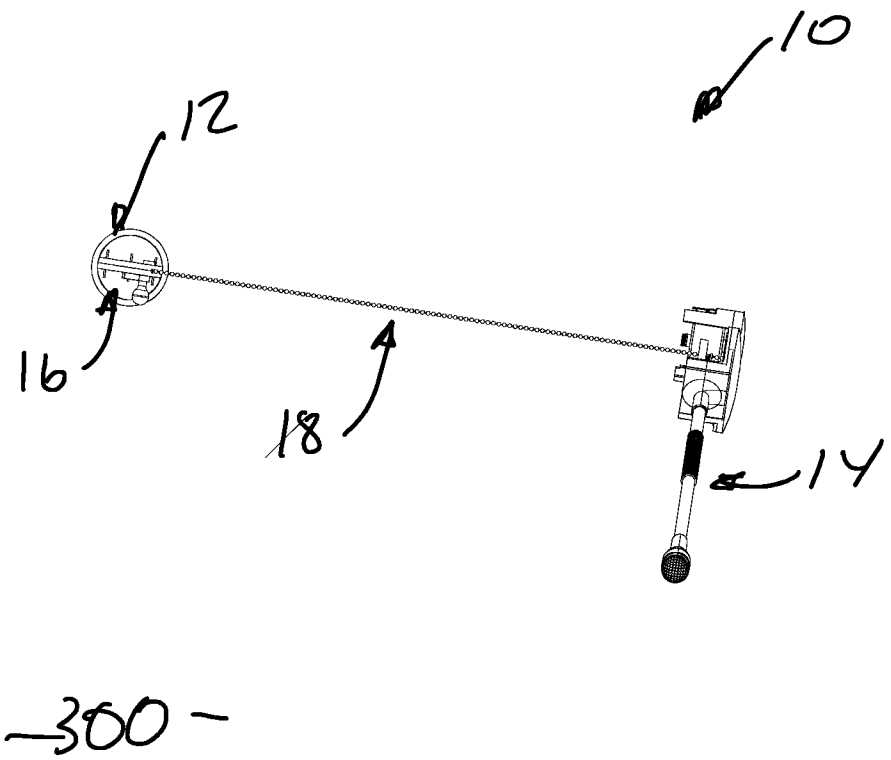
FIG. 2 of the drawings is top plan view of the putting green measuring system in use about a putting green.
Figure 3:
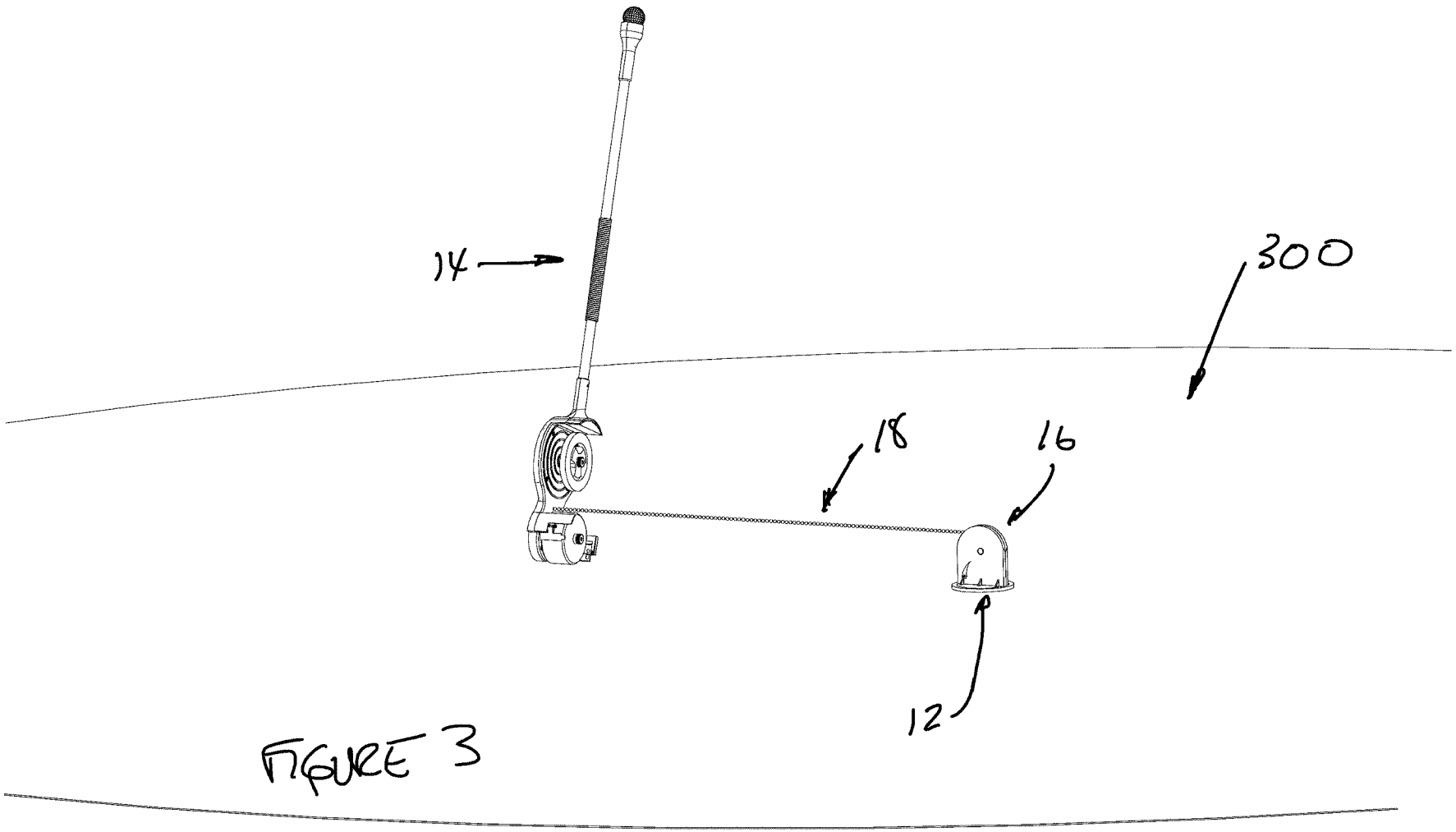
FIG. 3 of the drawings is a perspective view of the putting green measuring system in use about a putting green.

Referring now to the drawings and in particular to FIGS. 1, 2, and 3, the putting green measuring system 10 is shown, comprising central base 12, remote marking assembly 14, adjustable measurement assembly 16, and cable 18. The cable 18 known to be coupled to the remote marking assembly 14 in such a way that substantially restricts movement with reference to the amount of cable 18 available. Further, the cable 18 has its length altered by the adjustable measurement assembly 16. The adjustable measurement assembly is connected to the central base 12 in such a way that lit is permitted to rotate about the center axis of the central base 12.

Figure 4:
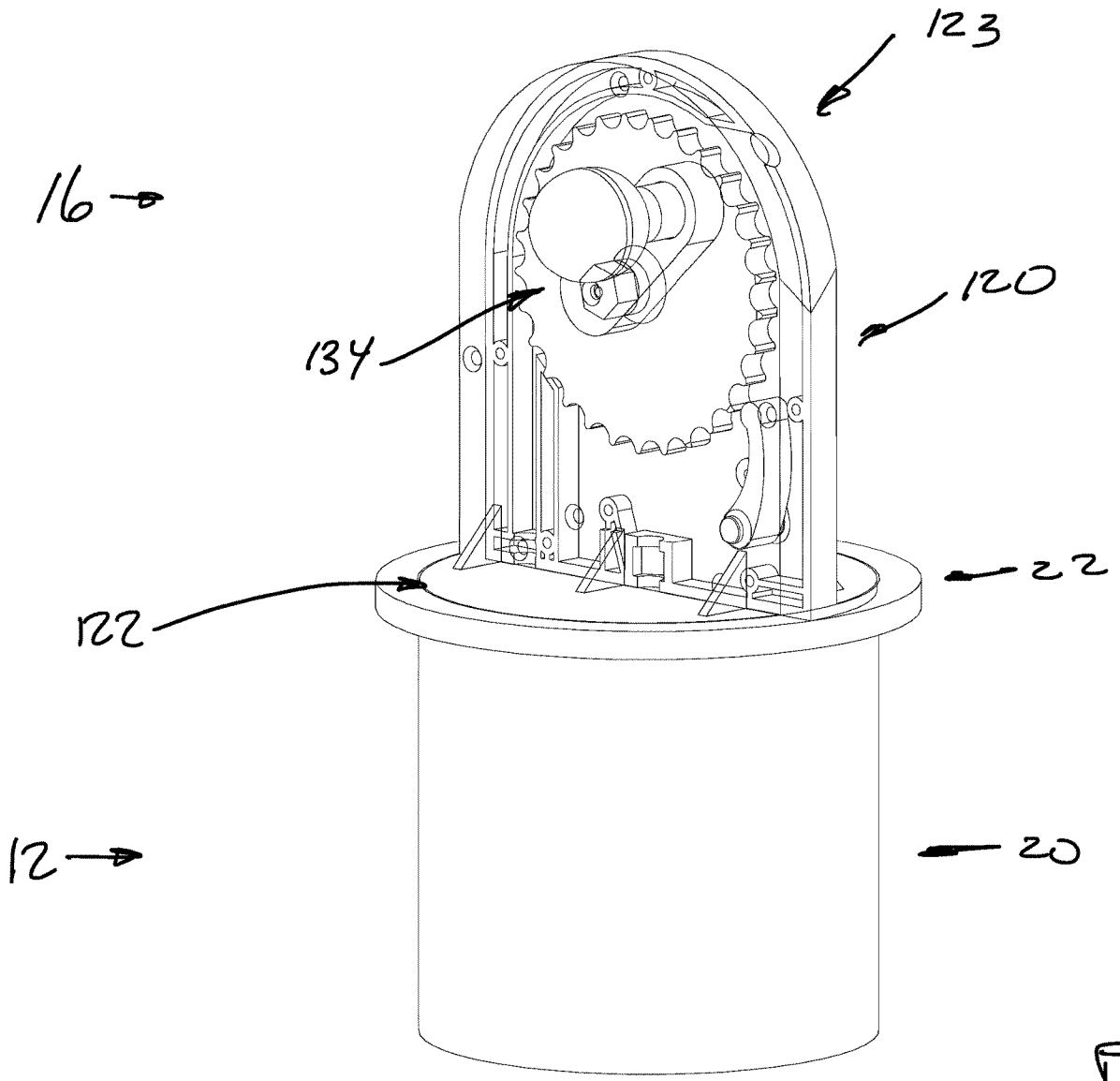
FIG. 4 of the drawings is a perspective view of the central body of the marking system.
Figure 5:
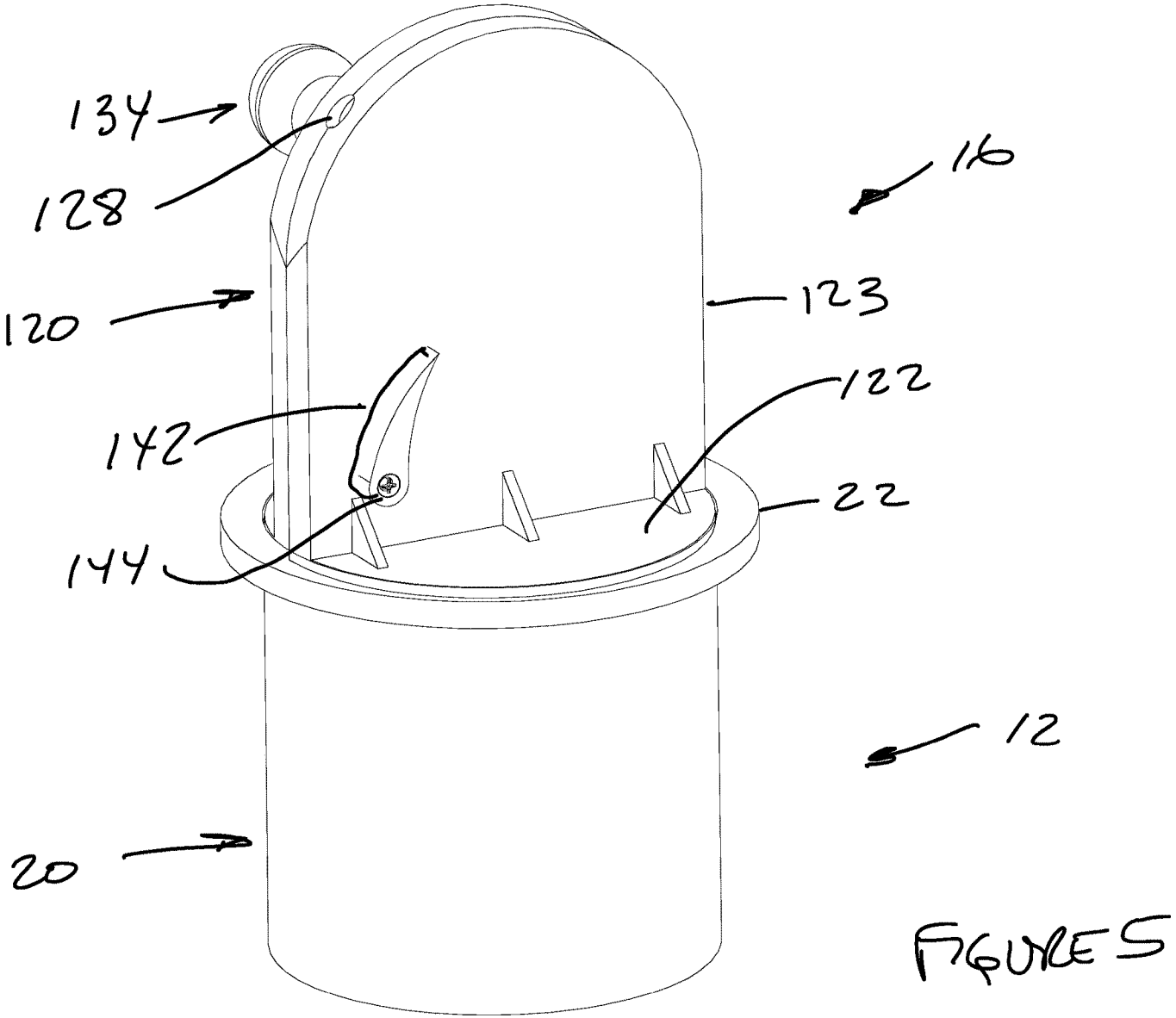
FIG. 5 of the drawings is a perspective view of the central body showing, in particular the release handle of the cable control assembly.
Figure 6:
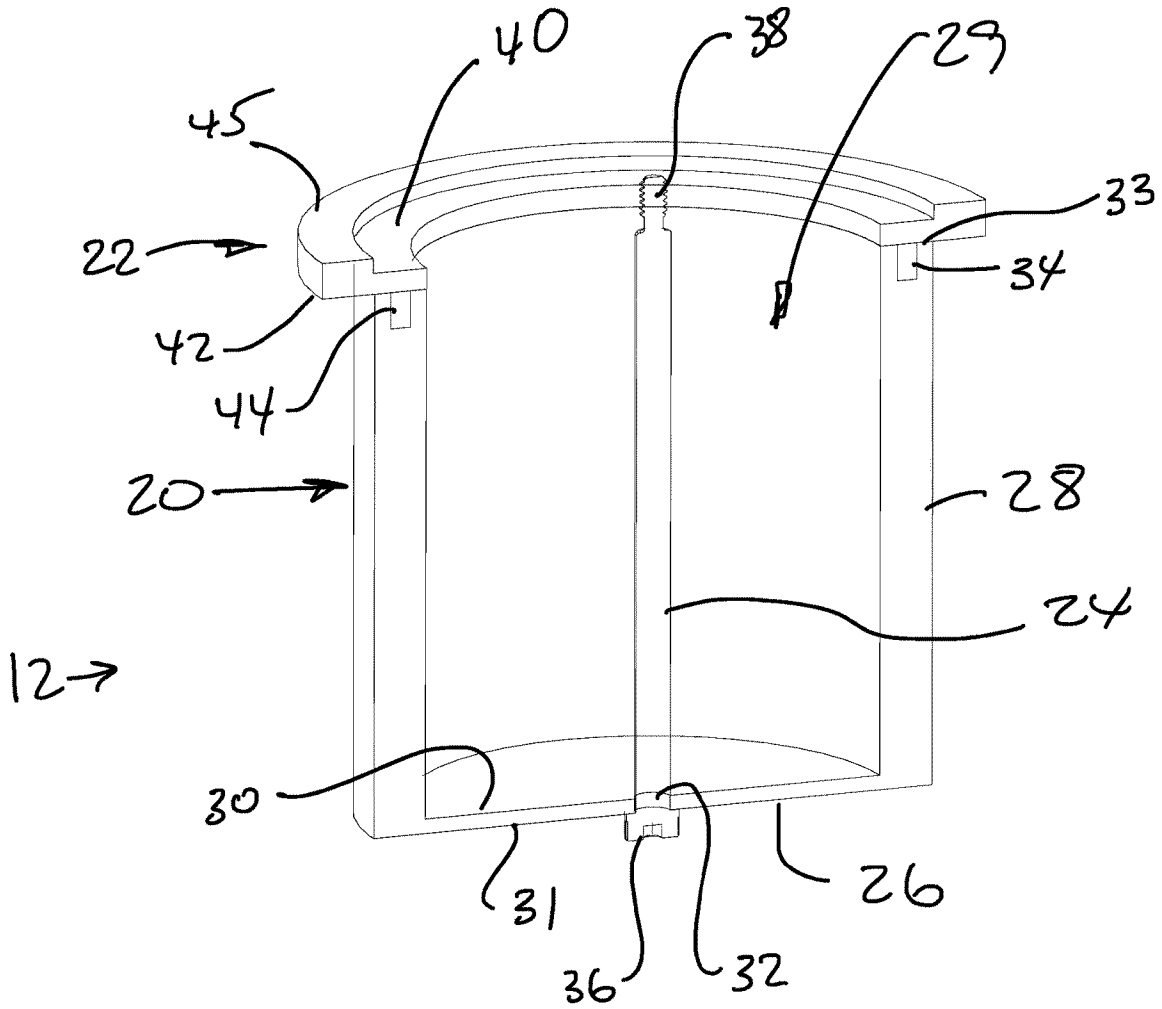
FIG. 6 of the drawings is a perspective cross-sectional view of the central base showing, in particular, the hole engaging outer body and upper engagement ring.

As shown in FIG. 4, 5, and in particular, FIG. 6, the central base 12 comprises hole engaging outer body 20, upper engagement ring 22, and pivoting axle 24. The hole engaging outer body 20 comprises base 26 and upstanding wall 28. It will be understood that the hole engaging outer body is configured to fit snugly within a conventional golf hole on the green. The base further comprises upper surface 30, lower surface 31, and opening 32. The upstanding wall further comprise upper end 33 and annular slot 34. The upper surface 30 and lower surface 31 are substantially opposite and parallel in reference to one another, separated by a variable distance that is subject to change in contemplated configurations of the design.

Opening 32 extends through both the upper surface 30 and the lower surface 31 and is defined thereby and positioned in substantially the center of base 26, but of variable radial dimensions that is may change in subsequent iterations of the design. The upper end 33 of the upstanding wall 28 is substantially above the upper surface 30 of base 26, extending to a length that is variable and subject to change in contemplated configurations, but desirably configured to correspond a requisite depth and dimension of a golf hole. Annular slot 34 is defined as an opening about the upper end 33 of the upstanding wall 28, extending into the upstanding wall 28 a substantial distance. The annular slot 34 may or may not be substantially encompass the upper end 33 of the upstanding wall 28. Further, a cavity 29 is defined by the base 26 and upstanding wall 28. The cavity has dimensions dependent upon the base 26 and upstanding wall 28 dimensions, and therefore is subject to change in subsequent iterations of the device. It will be understood that not only does the hole engaging body generally fix the position of the central base to the hole, but also serves as a collection container for excess parts of the cable 18, when in se.

As shown in the exemplary figure, the annular slot 34 has four instances of material of the upper end 33 present so as to divide the annular slot into quarter turn slices. This number is exemplary and may be as low as one or to any number suitable to the future iterations of the design. Further, it is to be understood, the upstanding wall 28 extends from base 26 about the outer perimeter of the upper surface 30. Shown in the configuration, the upstanding wall 28 and base 26 are cylindrical to fit substantially within a hole that the central base 12 may engage with. The size of the upstanding wall 28 and base 26, including dimensions, but not limited to, height, width, thickness, and radial size, are variable and subject to change for the appropriate use of the design.

The upper engagement ring 22 comprises bearing surface 40, lower lip 42, and depending tab 44. The bearing surface 40 further comprise an outer rim 45. The bearing surface 40 is substantially opposite and parallel to the lower lip 42. Further, the outer rim 45 is substantially opposite and parallel to the lower lip 42. The outer rim 45 is known to be substantially above and concentric to bearing surface 40. The height difference of the outer rim 45 above bearing surface 40 is variable and subject to change in contemplated configurations of the design. The depending tab 44 extends substantially perpendicular to the lower 42 and in such a way it is substantially matched to the annular slot 34 *o* the upstanding wall 28. The depending tab 44 may be made of any number of tab portions as low as one to ten, as an example. The configuration shown possess four depending tabs, matched to the number of annular slots 34.

It is to be understood that the upper engagement ring 22 couples to the hole engaging outer body 20 through interaction between the annular slot 34 of the upstanding wall 28 and the depending tab 44 of the upper engagement ring 22. Coupling is known to substantially limit the rotational movement of the upper engagement ring atop the hole engaging outer body 20. It is to be understood by those with sufficient skills in the art that the depending tab 44 must have dimensions substantially similar to those of the annular slot to create a coupling in such a manner. The specificity of these dimensions are variable and subject to change in contemplated configurations. These components may fit through an interference fit, or may be adhered or otherwise attached to each other.

The pivoting axle 24 comprises first end 36 and second end 38. The first end 36 and second end 28 are substantially opposite in reference to one another with the pivoting axle 24 extending from the first end 36 to the second end 38. The pivoting axle 24 may be of variable length dependent upon the contemplated configuration. The radial size of the pivoting axle 24 is dependent upon the size of the opening 32 of base 26. Further, the first end 36 may be of substantially larger size than that of the opening 32 in such a way that extension of the pivoting axle into the central base 12 is substantially restricted.

It is to be understood the upper engagement ring 22 is concentric about the pivoting axle 24 such that any distance measured from the pivoting axle to the upper engagement ring is substantially similar. It is to be understood by those with ordinary skill in the art that, with reference to previous disclosure of the materials and parts, this extends to include the pivoting axle 24 and the bearing surface 40, lower lip 42, depending tab 44, and the outer rim 45. The distance between the bearing surface 40, lower lip 42, depending tab 44, and outer rim 45 in reference to one another is variable and subject to change in contemplate configurations. Motion of the pivoting axle 24 is substantially limited by the opening 32 of the base 26 in relation to direct line motion. However, those with ordinary skill in the art will be familiar that rotational movement by the pivoting axle 24 is generally permitted, and the pivoting axle 24 is configured to rotate within the base 26.

Shown in FIG. 9 through 13, the remote marking assembly 14 comprises handle member 50, tape dispenser assembly 60, and cutting assembly 80. The handle member 50 comprises first end 52, second end 54, and grasping structure 56. The first end 52 and second end 54 are opposite one another with first end 52 above the second end 54. The grasping structure 56 is situated to the first end 52 of the handle member 50 and comprises a cradle 57. The cradle 57 is above the grasping structure 56 and is of a substantially shaped in such a way to holster objects, such as cylindrical or spherical objects.

It is to be understood the distance between the first end 52 and second end 54 is variable and subject to change in contemplated configurations. The grasping structure 56 is substantially coupled to the handle member 50 in such a way that rotational and linear movement about the handle member is substantially limited. Further, the grasping structure 56 coupled to the handle member 50 may be done so in different manners including, but not limited to, adhesive, bolts, screws, or other substantially coupling mechanisms. The cradle 57 of the grasping structure 56 may be of alternative shapes in contemplated configurations such that objects of varying sizes, shapes, or dimensions may be able to rest substantially within the cradle 57. These shapes may include, but are not limited to, hemispherical, cube, cylindrical, conical, or other such three dimensional shapes.

The tape dispenser assembly 60 comprises a frame 62, tape retainer sub-assembly 64, dispensing roller 66, and clamping flap 68. The frame comprises inner side 70, outer side 71, and cable opening 63. The inner side 70 is substantially coupled and parallel to the outer side 72 in such a way that rotational and linear movement is substantially limited. The cable opening 63 is defined as an opening that extends through the frame 62 and which is configured to receive the cable 18, at an end thereof. In the configuration shown, the inner side 70 and outer side 71 are coupled through screws or other fasteners in sufficient enough number to substantially reduce the independent movement of either side. In contemplated configurations, this coupling may include, but is not limited to, hook-and-loop members, bolts, adhesive, screws, or other such coupling mechanisms and materials. The cable opening 63 is known to be axially aligned through the inner side 70 and outer side 71.

The tape retainer sub-assembly comprises a central axle 72 and retaining ring 73. The central axle 72 is concentric to the retaining ring 73 and is radially mated to the ring in such a way that linear motion of the retaining ring 73 is substantially limited. Rotational movement of the retaining ring 73 about the central axle 72 is substantially unimpeded. It is to be understood the central axle 72 extends substantially through the retaining ring 73 of the tape retainer sub-assembly 64, and the inner side 70 and outer side 71 of the frame 62. A substantial distance of empty space exists between the inner side 70 and the retaining ring 73 about the central axle 72. This is, in the configuration shown, where the tape or other thin-walled length marking assembly will reside. The distance between the inner side 70 and the retaining ring is variable and dependent upon contemplated configurations. It is contemplated that tape, such as masking tape or the like can be installed hereon. The tape may be anywhere between ⅛" and 1" as well as both narrower and wider. It is further contemplated that a number of different tape rolls may be on the same central axle, depending on the configuration.

In the configuration shown, the retaining ring 73 is shown to have three prongs extending from the central axle 72. This is an exemplary configuration and future iterations may include as few as zero prongs (i.e., continuous) or as many as ten, or more. It is that the retaining ring 73 rotates about the central axle 72 and is maintained in such rotative coupling through a retaining ring or the like.

The dispensing roller 66 comprises central axle 74 and outer surface 75. The central axle is concentric to the outer surface 75 of the dispensing roller. The central axle 74 further extends through the dispensing roller 66, inner side 70, and outer side 71 of the frame 62. The central axle is substantially radially aligned to the dispensing roller 66 in such a way that the roller rotates about the central axle 74. The outer surface 75 of the dispensing roller 66 is substantially concentric to the central axle 74. Further, with reference to putting green 300 of the contemplated use of the device, the outer surface 75 is tangentially related to the surface of putting green 300. That is to say, when the dispensing roller 66 is in motion atop the putting green 300, the outer surface 75 is substantially tangential to the surface of the putting green 300 and engages the same.

The clamping flap 68 comprises pivot axle 76, contact edge 77 and biasing spring 78. The pivot axle 77 extends through the clamping flap 68 and the inner side 70 and outer side 71 of the frame 62, coupling the clamping flap 66 to the frame 62. The contact edge 77 is the edge of the clamping flap 68 in contact with the outer surface 75 of the dispensing roller 66. The biasing spring 78 of the clamping flap 68, positioned substantially between the pivot axle 76 and the clamping flap 68, further induces contact through biasing between the clamping flap 68 and the dispensing roller 66, along contact edge 77.

Figure 12:
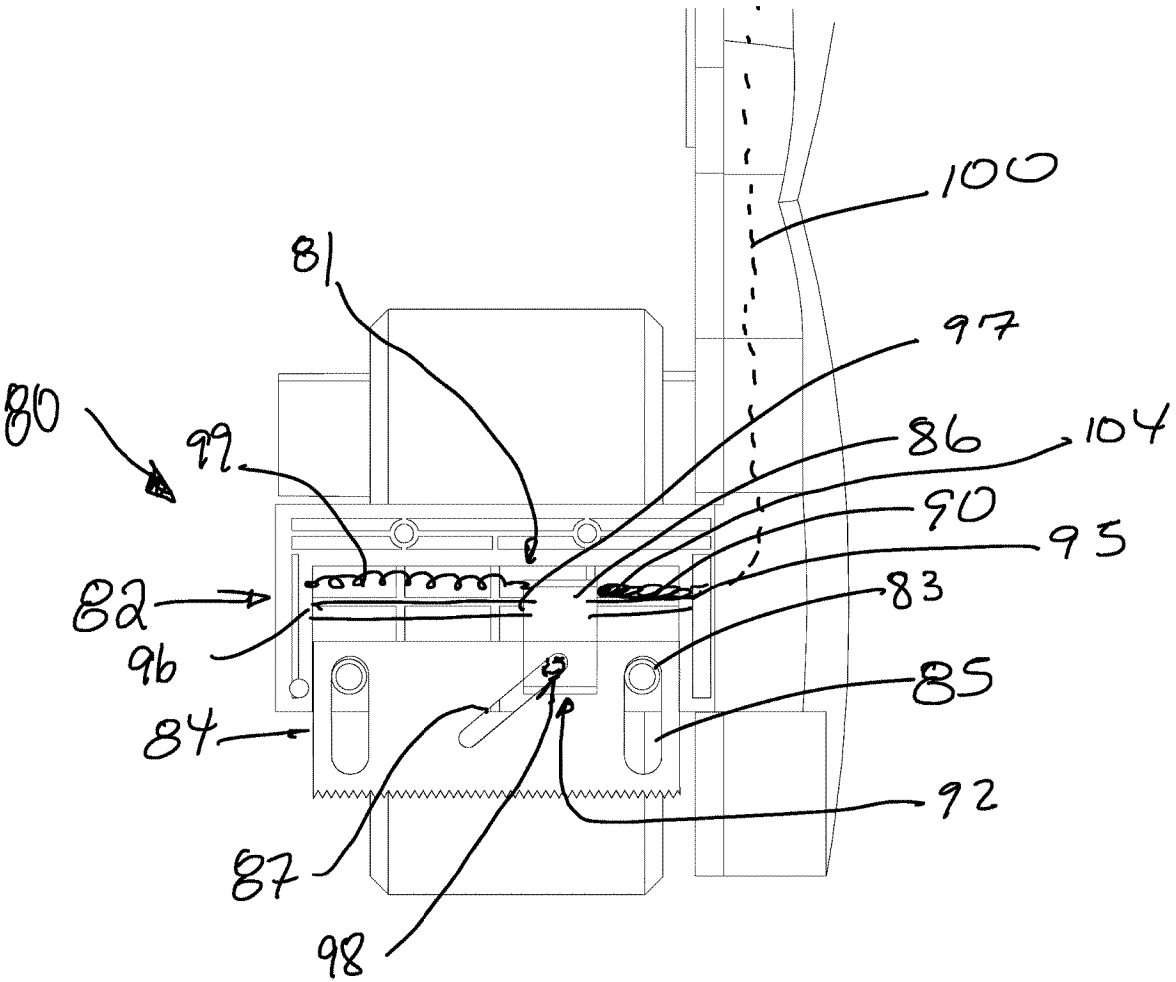
FIG. 12 of the drawings is cross-sectional of the remote marking assembly showing, in particular the cutting assembly and interaction with the handle member.
Figure 13:
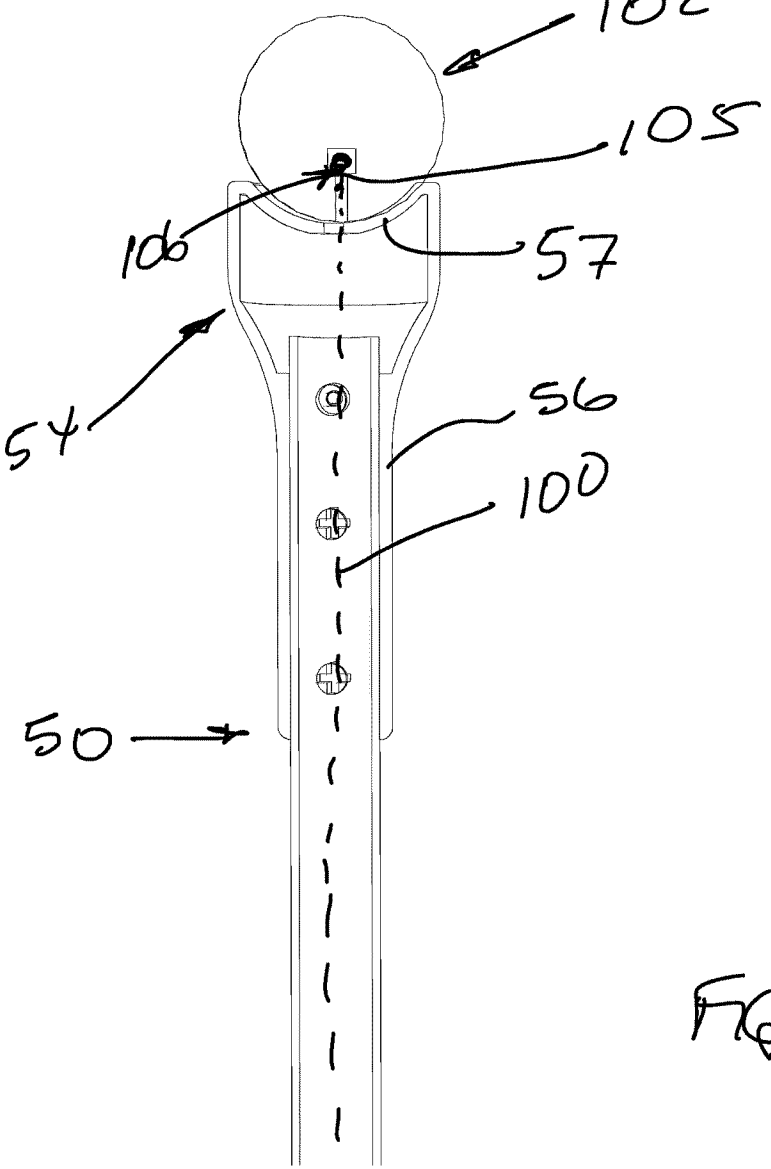
FIG. 13 of the drawings is a cross-sectional front view of the remote marking assembly showing, in particular the handle member and interaction with the cutting assembly.

Shown in FIGS. 12 and 13, the cutting assembly 80 comprises the blade housing 82, blade 84, and actuator 86. The blade housing 82 comprises slot 81 and transverse pins 83. The blade 84 comprises longitudinal slots 85 and oblique slot 87. The blade housing 82 slot 81 extends substantially about the length and height of the blade housing, defining an substantially open space within the blade housing 82, with transverse pins 83 extending from the surface of the blade housing 82 interior. The longitudinal slots 85 of blade 84 extends substantially vertically through blade 84 and are sized in such a way to be larger than the transverse pins 83 of the blade house 82 to allow for slidable relative movement therebetween. The oblique slot 87 of the blade 84 extends about the blade in a diagonal pattern from the blade's lower and outer edge to the upper and inner edge.

The actuator 86 comprises rail 90, blade engagement member 92, biasing member 99, and remote actuator assembly 94. The rail 90 comprises first end 95 and second end 96. The first end 95 and second end 96 are substantially opposite one another and extend substantially horizontal through the slot 81 of the blade housing 82. The blade engagement member 92 comprises a rail opening 97 and oblique slot engagement 98. The rail opening 97 engages with the rail 90 in such a way that the blade engagement 92 has sufficient movement available about the length of the rail 90 between first end 95 and second end 96*r*. The oblique slot engagement 98 engages with the oblique slot 87 of the blade. The biasing member 99 is coupled to the second end 96 of the rail 90 and to the blade engagement member 92.

The remote actuator assembly 94 comprises cord 100 and grasping actuator 102. The cord 100 further comprise first end 104 and second end 105. The grasping actuator 102 further comprise cord coupling 106. The cord 100 extends from the cutting assembly 80 through the remote marking assembly up to the handle member 50. In the shown configuration, the cord 100 is positioned within the remote marking assembly. In contemplated configurations, the cord may be partially or wholly external to the remote marking assembly or a combination of internal and external depending upon future iterations of the device. The first end 104 of the cord 100 is coupled to the blade engagement member 92. The second end 105 of the cord 100 is coupled to the cord coupling 106 of the grasping actuator 102. The cord coupling 106 is positioned within the grasping actuator 102 which is above the cradle 57 of the grasping structure 56. The method of coupling for the first end 104 and second end 105 may include, but is not limited to, tight fit connection, bolt assistance, adhesive, loop-and-hook, or other such methods. In the configuration shown, the grasping structure 102 is spherical in shape. It is to be understood the shape of the grasping structure may include, but not limited to, spherical, cuboidal, conical, multi-levered, angular, or other such shapes.

Cord 100 may be of uniform shape and variable length dependent upon the length handle member 50 and the remote marking assembly 14. It is to be understood the length and dimensions of cable 100 may be varied. The cord coupling 106 is situated substantially within the grasping actuator 102 by a method that may include, but is not limited to, tight-fitting, adhesive, bolts, screws, or other movement limiting sizes of the materials.

The longitudinal slots 85 of the blade 84 interact with the transverse pins 83 of the blade housing 82 in such a way to direct the blade predominantly in the vertical direction. The biasing member 99 further returns the blade engagement member 92 to such a position that the blade 84 is move vertically following user defined motion of the remote actuator assembly 94. That is to say, following the remote actuator assembly 94 moving the blade engagement member 92 and blade 84, the biasing member 99 returns the blade engagement member 92 to separate the same from the ground and to return it to a configuration that is spaced apart from the ground.

Figure 7:
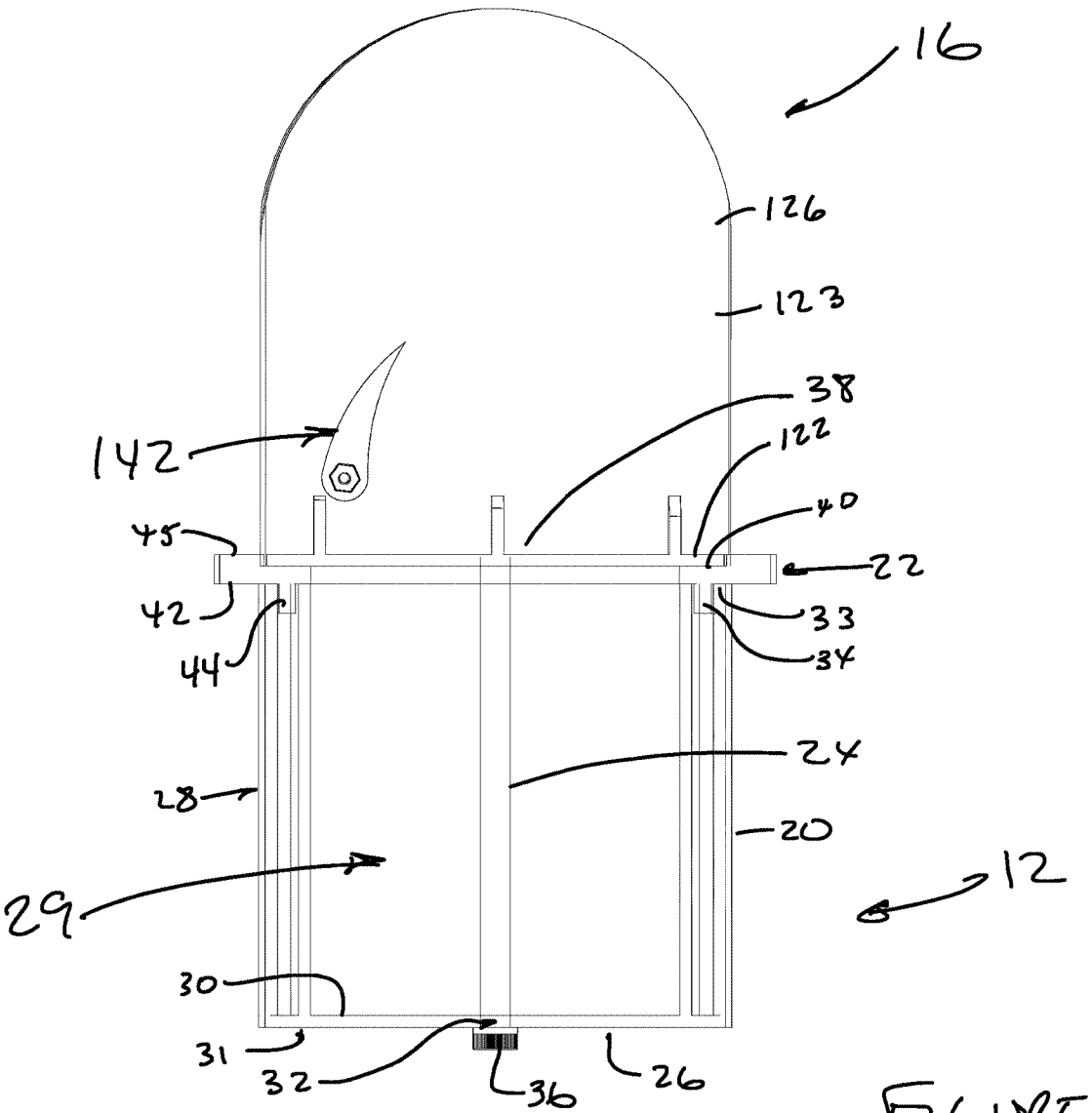
FIG. 7 of the drawings is a cross-sectional view of the central base and adjustable measurement system.
Figure 8:
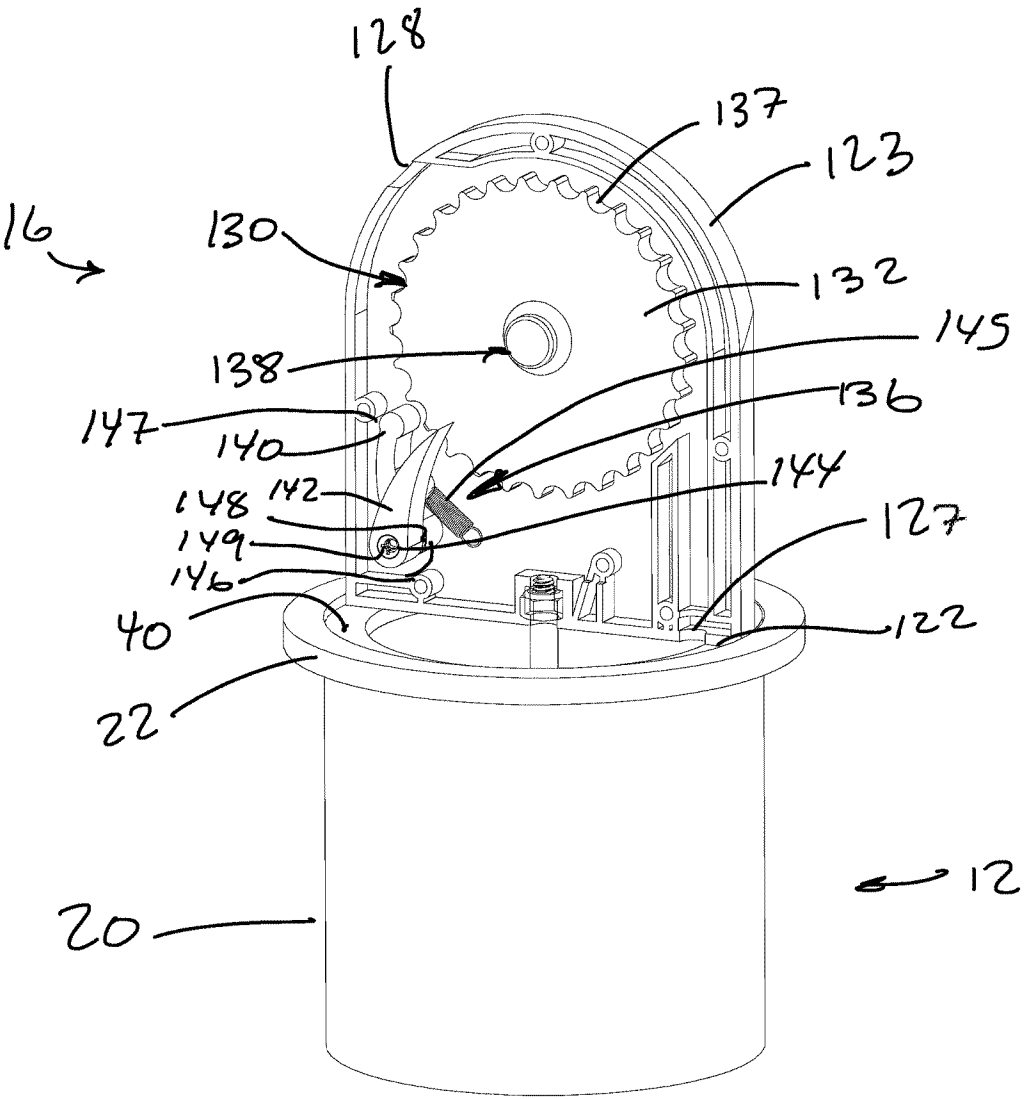
FIG. 8 of the drawings is a perspective view of the adjustable measurement system with a portion of the upstanding structure removed, showing, in particular, the housing and cable control assembly.
Figure 9:
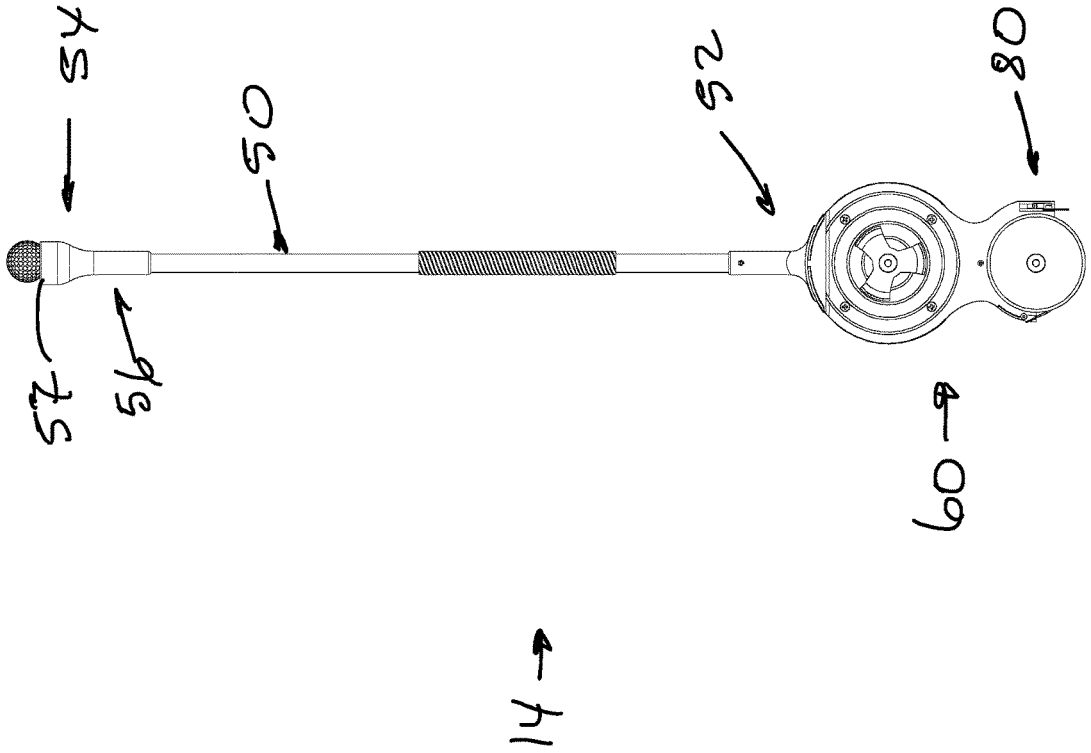
FIG. 9 of the drawings is a front view of the remote marking assembly showing, in particular, the handle member.
Figure 10:
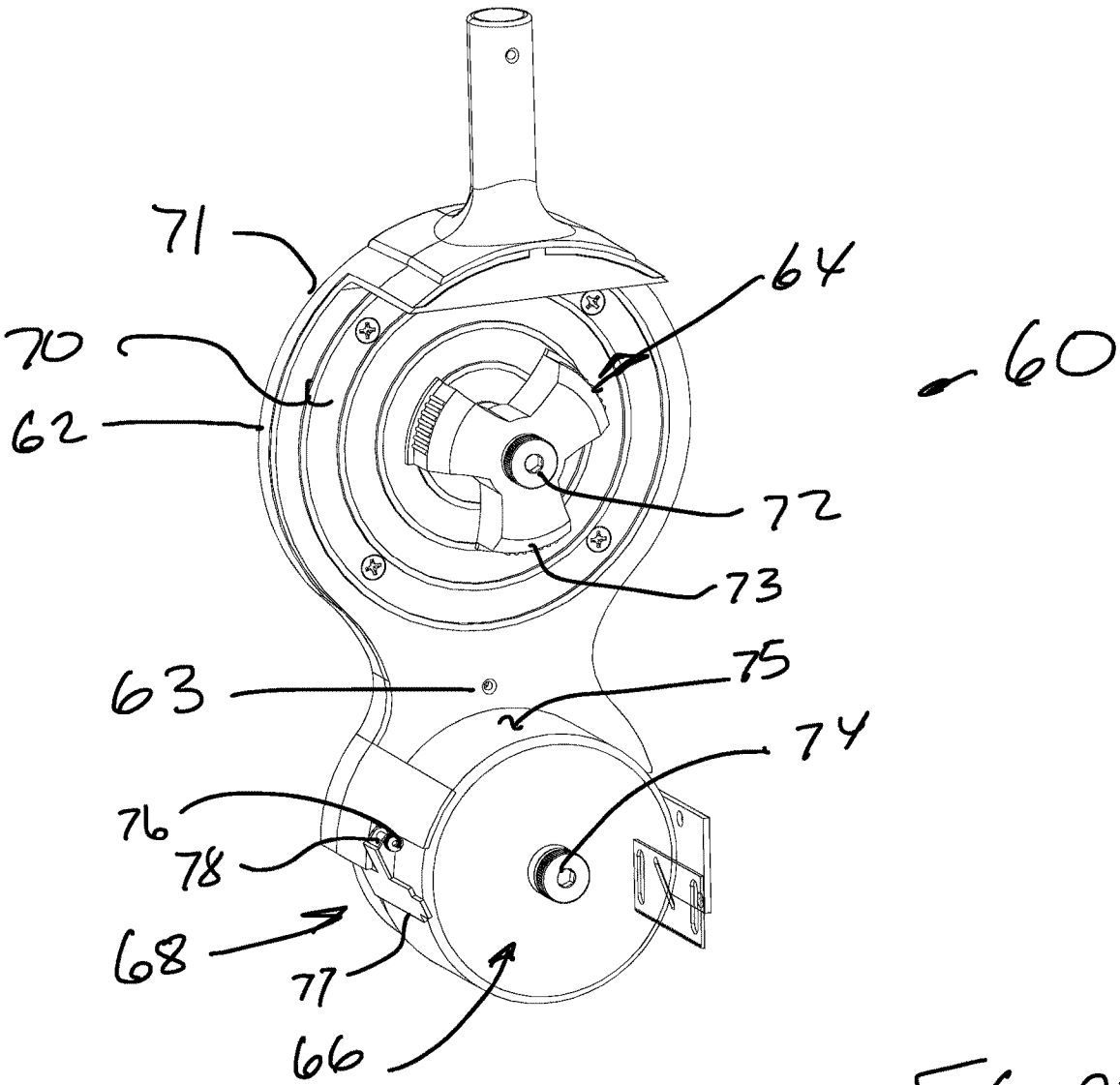
FIG. 10 of the drawings is a perspective view of the remote marking assembly with the handle removed, showing, in particular, the tape dispenser assembly.
Figure 11:
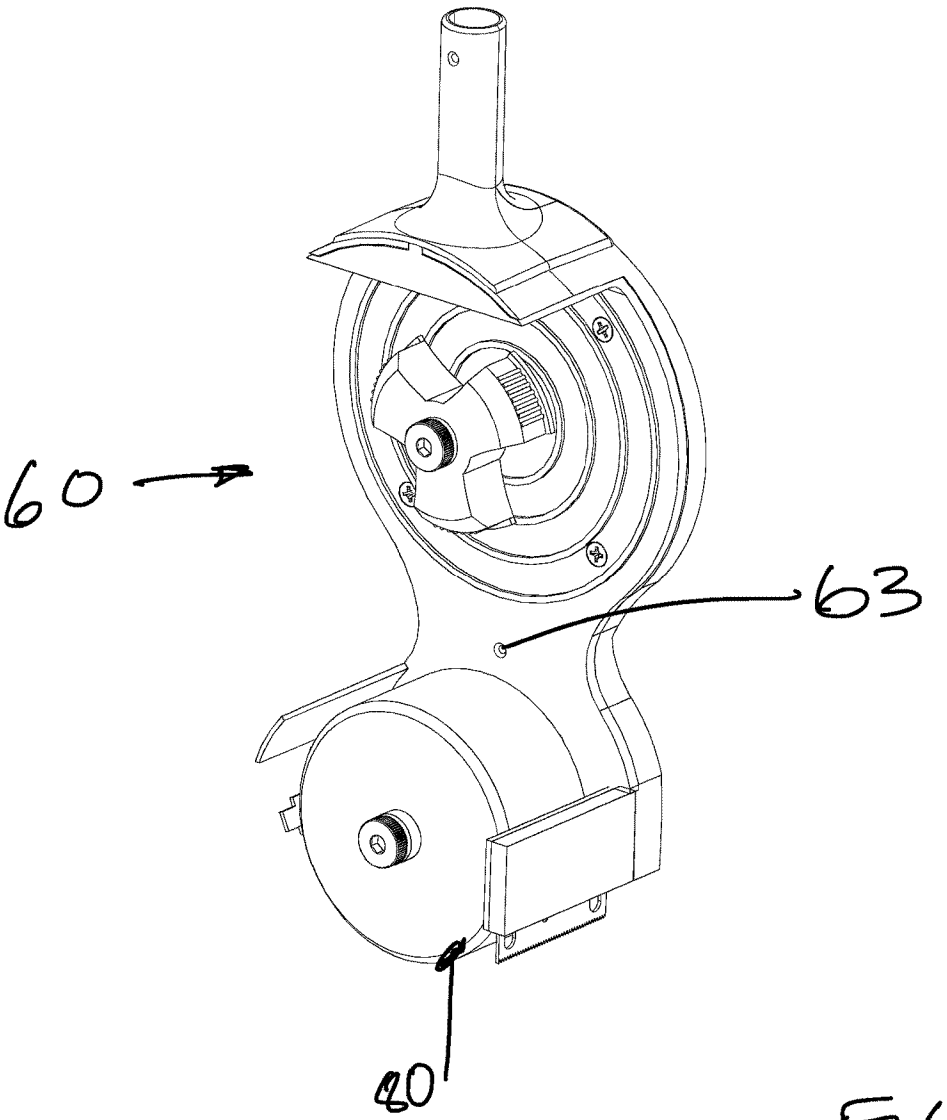
FIG. 11 of the drawings is a perspective view of the remote marking assembly showing, in particular, the cable coupling.

The adjustable measurement assembly, shown in FIGS. 4, 7, and 8, comprises housing 120 and cable control assembly 130. The housing comprises base engagement surface 122 and upstanding structure 123. The upstanding structure further comprise opposing walls 126, supply opening 127, dispensing opening 128, handle axle opening 129, and release handle opening 124. The base engagement surface 122 is mated to the bearing surface 40 of the upper engagement ring, with the outer rim 45 substantially exterior and above the base engagement surface 122. The upstanding structure is substantially perpendicular to the base engagement surface, in the configuration shown, extending upwards at a variable height dependent upon future iterations of the device. The opposite walls 126 of the upstanding structure 123 define a cavity 125 within the housing 120. The opposing walls 126 further define supply opening 127, dispensing opening 128, handle axle opening 129 and release handle opening 124.

The supply opening 127 extends through the base engagement surface 122 and into the cavity defined by the hole engaging outer body 20 of the central base. The dispensing opening 128 is extends from the cavity 25 to the exterior surface of the housing 120. The handle axle opening 129 extends through one opposing wall in such a way the extension is substantially parallel to the base engagement surface 122. The release handle opening 124 extends through one opposing wall in such a way that the extension is substantially parallel to the base engagement surface 122.

In the configuration shown, the handle axle opening 129 is above the release handle opening 124. Further the two are shown to be on opposite opposing walls, while other configurations are contemplated. Further, including the supply opening 127 and dispensing opening 128, the sizing of openings may change in both depth, width, and other appropriate dimensions depending upon particular configurations.

The cable control assembly 130 comprises cogged wheel 132, cog handle 134, and pawl assembly 136. The cogged wheel 132 further comprise cogs 137 and central axle 138. The cogged wheel 132 is positioned within the cavity 125 of the housing 120 and is coupled to the opposing walls 126 by central axle 138. The pawl assembly 136 comprises pawl 140, release handle 142, axle 144, and biasing member 145. The pawl further comprises first end 146, second end 147, and pivot opening 148. The release handle 142 further comprise a pivot opening 149.

The central axle 138 is concentric to the cogs 137 so that the cogs rotate about the central axle. Further, the central axle substantially couples to the cog handle 134. The cog handle 134 is situated outside the opposing walls 126 of the upstanding structure 123, interacting with the cogged wheel 132 through the handle axle opening 129. Movement of the cogged wheel 132 within the cavity 125 rotates the cogs 137 about the central axle 138 at a rate that is substantially equal to the cog handle 134 rotation. The pawl 140 of the pawl assembly 136 has pivot opening 148 axially aligned with the pivot opening 149 of the release handle 142. The first end 146 is nearest the pivot opening 148 in the configuration shown and the second end 147 of the pawl 140 is position in such a way next to the cogged wheel 132 that interaction between the two substantially limits the rotation of the cogged wheel 132. The release handle 142 is outside the opposing walls 126 and is substantially coupled to the pawl 140 through axle 144. Further, a biasing member 145 interacts with the pawl 140 in such a way to selectively restrict movement of the cogged wheel dependent upon the position of the releasing handle 142.

The axle 144 couples the release handle 142 and the pawl 140 in such a way that radial motion of one about the axle relates in a substantially matched rotation of the other. That is to say, the second end 147 of the pawl interacts with the cogs 137 of the cogged wheel to allow rotation in a first direction, while precluding rotation in a second direction (until released).

Rotation of the cog handle 134 relates to rotation of the cogged wheel 132 through interactions between the central axle 138 and the cogged handle 134. This movement, as previously described, is limited with the pawl 140 is placed in an engaged position with the cogged wheel 132 and the cog is rotated in a direction that forces the pawl against the cog. The number of cogs 137 on the cogged wheel 132 is exemplary in the shown configuration. Further, the engagement of the second end 147 of the pawl to the cogged wheel 132 is dependent upon the shape of the cogs, but both are subject to change in shape in future iterations, including the distance between subsequent cogs 137, size of the cogged wheel 132, and other such parameters.

Figure 14:
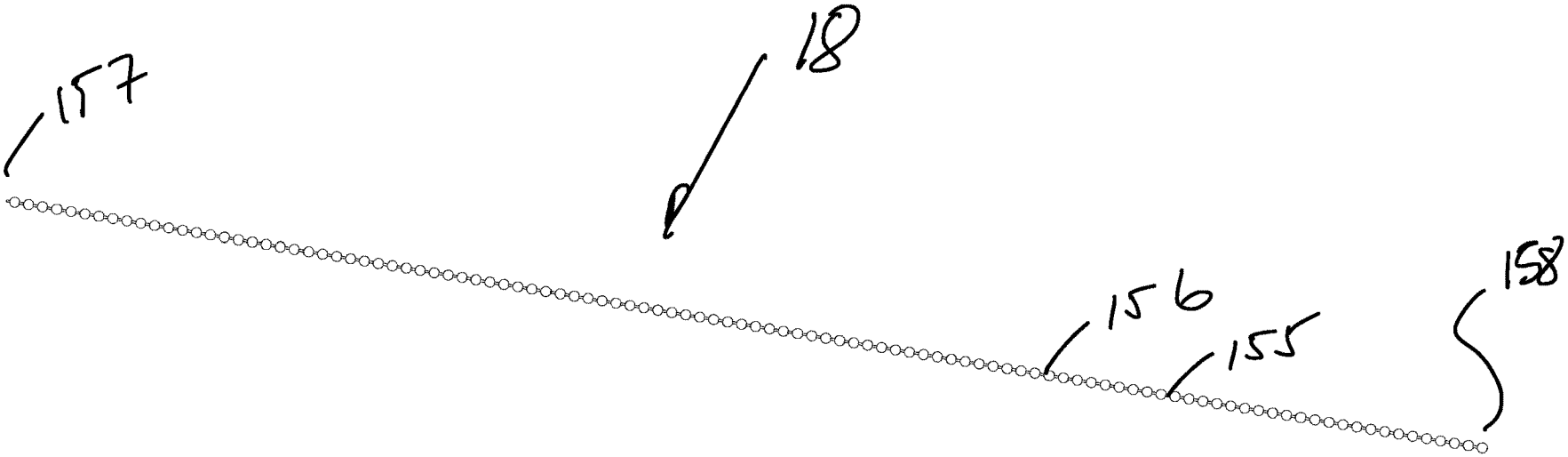
FIG. 14 of the drawings is a perspective view of the cable.
Figure 15:
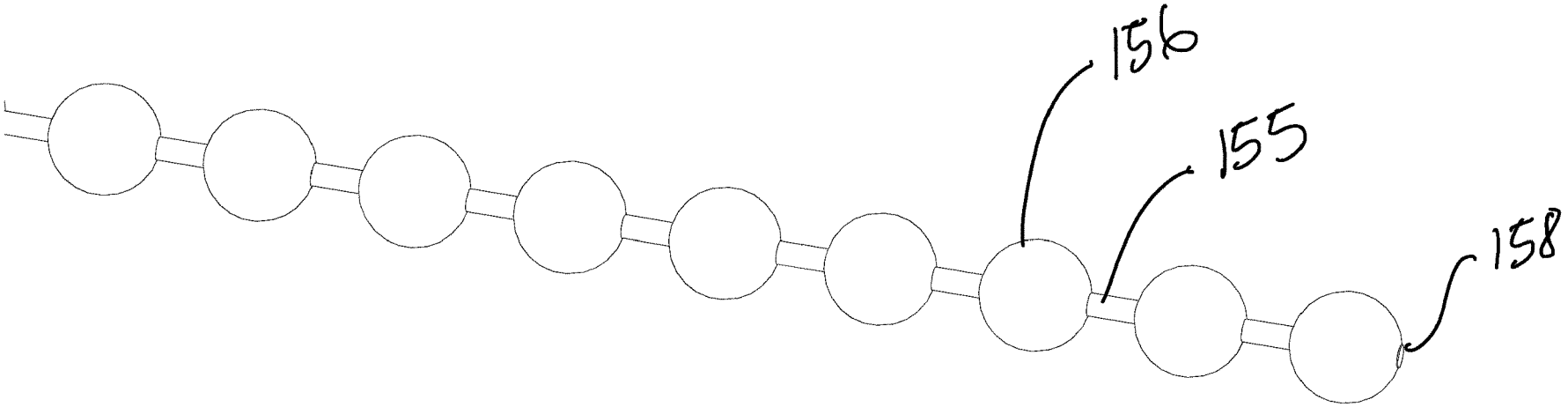
FIG. 15 of the drawings is a partial perspective view of the cable showing, in particular, the cogs and members.

The cable 18, shown in FIGS. 14 and 15, comprise a base member 155, cogs 156, first end 157, and second end 158. The cable extends the length of the first end 157 to the second end 158, with a length dependent upon the size and number of the base members 155 and cogs 156. The base members 155 are shown in the contemplated configuration to be thin generally flexible materials connecting to cogs 156 in a substantially sequential manner.

In the shown configuration, the cable has base members 155 coupled to cogs in a continuous and opposite manner. That is, two base members 155 attached to one cog 156 are substantially opposite one another along the cable 18. The cogs 156 are substantially stiff materials with base members 155 allowing for motion of the cable 18. Cable 18 motion may include, but is not limited to, wrapping about a cylindrical surface, balling into a singular shape, extending in a straight line, or other such shapes possible for chains.

An exemplary use of the measuring system 10 will now be described herein. It is to be known that the following description is exemplary and based upon the configuration shown.

As shown in FIG. 1, the putting green measuring system 10 is used on a putting green 300. The central base 12 is placed within a suitably sized hole such that the hole engaging outer body 20 is sufficiently mated to all sides of the hole. This engagement is meant to limit the motion of the central base 12 within the hole. The upper engagement ring 22 couples with the annular slot of the hole engaging outer body, creating a platform for the adjustable measurement assembly 16 to mate to. Cable 18 is stored within the cavity 29 of the hole engaging outer body in a manner that allows to move through the adjustable measurement assembly 16 when used. More specifically, the cable 18 moves from the cavity 29 through the supply opening 127 of the upstanding structure, into the cavity 125, and finally exist the housing 120 of the adjustable measurement assembly 16 through the dispensing opening 128.

The cable 18 moves freely from the adjustable measurement assembly 16 to the remote marking assembly 14, coupling substantially to the frame 62 of the tape dispenser assembly 60. More specifically, it couples to the cable opening 63 in a way that substantially couples the cable 18 between the remote marking assembly 14 and the central base 12. The distance between the central base 12 and the remote marking assembly 14 is dependent upon the length of the cable 18 that is extended from the central base 12.

The length of the cable 18 is adjustable through the adjustable measurement assembly 16. Using the cog handle 134 of the cable control assembly 130, the length of the cable 18 may be lengthened or reduced dependent upon the direction of rotation of the cog handle 134. Rotation to lengthen the cable facilitates movement of the cable across the cogged wheel 132. More specifically, the cogs 156 of the cable 18 are connected to the cogs 137 of the cogged wheel. Rotation of the cog handle 134, and by extension the central axle 138 and cogged wheel 132, directs the motion of the cable about the cogged wheel. Base members 155 of cable 18 connect the cogs 156 in the facilitated motion.

When the cable 18 is extended to a desired length, the release handle 142 may be engaged, thereby engaging the pawl 140 to the cogged wheel 132, limiting the motion of the cable through the cable control assembly 130. The biasing member 145 keeps the pawl 140 in place along the cogged wheel 132, substantially limiting the motion of the cable 18 in reference to the cogged wheel 132.

Tape, as the suitable thin-walled marking system will be referred to herein, is attached to the central axle 72 of the tape retainer sub-assembly 64 in such a way that substantially limits movement opposed to the central axle 72. The retaining ring 73 holds the tape in place. The tape is extended downwards in reference to the frame 62 until it is attached to the dispensing roller 66, or more specifically the outer surface 75. The central axle 74 of the dispensing roller allows the outer surface 75 to rotate about it and along the putting surface 300.

During said movement, the tape is moved from the outer surface 75 to the putting green surface 300 once contact is made. This contact depends upon the method of securement the tape has to the putting green 300 and may include, but is not limited to, adhesives or other such methods. The clamping flap 68 of the tape dispenser is present with the contact edge 77 To maintain the tape in the correct path. The biasing spring 78 of the clamping flap substantially ensures a tight connection to the outer surface 75.

The remote marking assembly 14 is moved about the central body 12 with the cable 18 limiting the distance the remote marking assembly 14 may be from the hole. In this system, the length of cable 18 creates the known radius of the circle which the remote marking assembly 14 will travel along during movement. The mating between the upper engagement ring 22 and the hole engaging outer body 20 allows rotation of the adjustable measurement assembly 16 axially in relation to the hole. That is due to the mated and uncoupled connection between the adjustable measurement assembly 16 and the central body 12, the cable may move uninterrupted about the hole thanks to the rotational movement of the adjustable measurement assembly about the central body 12 center axis. This freedom of rotation creates a substantially equal circle about the hole.

Once the remote marking assembly 14 has circled the hole and reached a desired location, the cutting assembly 80 may be engaged. The cutting assembly is operated by the user, in the shown configuration, pulling on the grasping actuator 102 of the remote actuator assembly 94. The pulling of the grasping actuator 102 engages the cord coupling 106 to create tension with cord 100, through the second end 105 and to the first end 104. This increase in tension facilitates movement of the blade engagement member 92, moving, in the configuration shown, from the second end 96 towards the first end 95 of the rail 90. This movement, forces the oblique slot 87 of the blade 84 to move in tandem with the oblique slot engagement 98 of the blade engagement member 92. This movement engaged with the blade 84 facilitates vertical motion of the blade downwards, intersecting with the tape about the outer surface 75. With a substantially sharp blade, the tape will be severed and stopping the marking of the green 300. Releasing the remote actuator assembly 94 then forces the blade engagement member 92 towards the first end 95 of the rail, due to the force facilitated by the biasing member 99. The blade housing 82 then houses the blade 84 until such time the remote actuator assembly is engaged again.

These steps may be repeated over and over again, after adjustment of the cable to a different length. As such, a number of concentric circles may be created about the hole, axially spaced apart from each other.

Due to the configuration of the pawl and the cogs, a simple spinning of the cogged wheel by way of the handle, can pull the cable back into the device, and into cavity 29. That is, the pawl can ratchet and move out of the way as the two are rotated relative to each other.

It will be understood that in other configurations, the adjustable measurement assembly may be positioned on the remote marking assembly with the cable being rotatably coupled to the central base at the one end and to the adjustable measurement assembly at the other end.

It will further be understood that the adjustable measurement assembly can be decoupled from the remote marking assembly (or from the central base) to allow a user to use the remote marking assembly to make lines (straight, curved or otherwise) along the green, to, for example, follow the break on putts.

In still other configurations, the tape system may be replaced with another marking system, such as a paint (such as a spray bottle or the like), or some type of lawn marking pen, marker or applicator. The same principles can be utilized to achieve a circle that is concentric with the cup.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A putting green measuring device comprising:

a central base positionable within a hole on a putting green;

a remote marking assembly structurally configured to retain a tape and to apply the same when traversed across the putting green;

a cable extending from the remote marking assembly and the central base;

an adjustable measurement assembly positioned on one of the central base and the remote marking assembly to controllably determine and maintain a length of the cable between the remote marking assembly and the central base;

a hole engaging outer body; and an upper engagement ring rotatably coupled to the hole engaging outer body;

wherein the adjustable measurement assembly is positioned on the upper engagement ring and rotatable relative to the hole engaging outer body.

2. The putting green measuring device of claim 1 wherein the central base further includes a pivoting axle coupled to each of the hole engaging outer body and the upper engagement ring, wherein the upper engagement ring is rotatable relative to the hole engaging outer body about an axis defined by the pivoting axle.

3. The putting green measuring device of claim 1 wherein the upper engagement ring further includes an upstanding wall defining an annular slot, with the upper engagement ring having a depending tab structurally configured to be positionable within the annular slot.

4. The putting green measuring device of claim 3 wherein the upstanding wall has an outer surface that substantially corresponds to a cup on a putting green.

5. A putting green measuring device comprising:

a central base positionable within a hole on a putting green;

a remote marking assembly structurally configured to retain a tape and to apply the same when traversed across the putting green;

a cable extending from the remote marking assembly and the central base; and an adjustable measurement assembly positioned on one of the central base and the remote marking assembly to controllably determine and maintain a length of the cable between the remote marking assembly and the central base wherein the adjustable measurement assembly further comprises a cable control assembly comprising a cogged wheel and a pawl assembly, the pawl assembly including a pawl structurally configured to retain the cogged wheel in a desired orientation; and wherein the adjustable measurement assembly further includes a housing extending over the cable control assembly, the housing having an opening to a cavity within the central base in which a portion of the cable can be stored.

6. The putting green measuring device of claim 5 wherein the pawl assembly is configured to allow rotation of the cogged wheel in a first direction, while precluding rotation of the cogged wheel in a second direction, which is opposite of the first direction.

7. The putting green measuring device of claim 6 wherein the pawl assembly further includes a biasing member, with a release handle configured to allow a user to overcome the biasing member, so as to separate the pawl from the cogged wheel.

8. The putting green measuring device of claim 5 further comprising a handle coupled to the cogged wheel, the handle configured to allow for user rotation of the cogged wheel.

9. The putting green measuring device of claim 5 wherein the housing encases the cogged wheel, and includes a dispensing opening configured to allow the cable to exit the housing, while a portion of the cable remains engaged with the cogged wheel.

10. A putting green measuring device further comprising:

a central base positionable within a hole on a putting green;

a remote marking assembly structurally configured to retain a tape and to apply the same when traversed across the putting green;

a cable extending from the remote marking assembly and the central base; and an adjustable measurement assembly positioned on one of the central base and the remote marking assembly to controllably determine and maintain a length of the cable between the remote marking assembly and the central base;

a handle member having a first end and a second end, with the cable being attached to the handle member proximate the second end; and a tape dispenser assembly positioned at the second ends;

wherein the tape dispenser assembly includes a dispensing roller having an axis that is substantially perpendicular to an axis defined by the handle member.

11. The putting green measuring device of claim 10 wherein the remote marking assembly further includes a cutting assembly, structurally configured to cut tape that is dispensable from the tape dispenser assembly.

12. The putting green measuring device of claim 11 wherein the cutting assembly further includes a movable blade and a remote actuator assembly configured to move the blade relative to the tape dispenser assembly.

13. The putting green measuring device of claim 12 wherein the remote actuator assembly comprises a cord having a first end and a second end, with the first end being coupled to the blade and a second end extending through the handle member to the first end thereof, and attached to a grasping structure, whereupon movement of the grasping structure relative to the first end of the handle member moves the cord, and in turn, the blade.

14. The putting green measuring device of claim 1 wherein the cable comprises a base member with a plurality of spaced apart cogs.

15. The putting green measuring device of claim 1 wherein the adjustable measurement assembly is coupled to the central base.

* * * * *